US008479346B1

(12) United States Patent
Raghuprasad

(10) Patent No.: US 8,479,346 B1
(45) Date of Patent: Jul. 9, 2013

(54) SPLATTER-FREE GRILL CLEANER

(76) Inventor: Puthalath Koroth Raghuprasad, Odessa, TX (US)

( * ) Notice: Subject to any disclaimer, the term of this patent is extended or adjusted under 35 U.S.C. 154(b) by 0 days.

(21) Appl. No.: 13/551,841

(22) Filed: Jul. 18, 2012

(51) Int. Cl.
*A47L 13/02* (2006.01)
*A47L 13/06* (2006.01)
*A47L 13/12* (2006.01)

(52) U.S. Cl.
USPC ..... 15/111; D4/122

(58) Field of Classification Search
USPC ..... 15/111; D4/122
See application file for complete search history.

(56) References Cited

U.S. PATENT DOCUMENTS

| | | | | |
|---|---|---|---|---|
| 3,196,473 | A * | 7/1965 | Bell | 15/23 |
| 3,402,414 | A | 9/1968 | Bell | |
| 4,146,943 | A * | 4/1979 | Wertheimer et al. | 15/111 |
| 5,373,600 | A | 12/1994 | Stojanovski | |
| 6,817,932 | B2 | 11/2004 | Furey | |
| 7,168,124 | B2 | 1/2007 | Dallas | |
| D546,066 | S | 7/2007 | Rothman | |
| D567,510 | S | 4/2008 | Tuli | |
| D641,555 | S * | 7/2011 | Schochet | D4/102 |
| 2009/0188061 | A1 | 7/2009 | Cybulski | |
| 2009/0199868 | A1 | 8/2009 | Cybulski | |
| 2009/0255075 | A1 | 10/2009 | Carlson | |

FOREIGN PATENT DOCUMENTS

| | | |
|---|---|---|
| WO | 2010015532 | 2/2010 |

* cited by examiner

*Primary Examiner* — Randall Chin
(74) *Attorney, Agent, or Firm* — David L King

(57) ABSTRACT

A grill cleaning device has a handle, a scraper and a rotatable bristled cleaning wheel assembly. The handle has a handle end portion and a cleaning end portion. The scraper projects from the cleaning end portion. The rotatable bristled cleaning wheel assembly has a rotatable axle held in the cleaning end portion. The bristled cleaning wheel assembly is affixed to the axle. The bristled wheel assembly has substantially radially extending cleaning bristle wheels on each of the lateral ends of the cleaning wheel assembly and two sets of opposing laterally extending bristles. Each set of lateral bristles projects inwardly from a wheel rim toward a lateral center of the wheel assembly. The bristles are made from sturdy non-rusting metal. The ends of the laterally extending bristles are spaced from the center of the wheel assembly a distance equal to or slightly less than a grill rod.

20 Claims, 11 Drawing Sheets

SPLATTER-FREE GRILL CLEANER

TECHNICAL FIELD

This invention relates to a device used to clean barbeque grills.

BACKGROUND OF THE INVENTION

Barbeque grills routinely accumulate charred debris from cooked foods that adhere stubbornly to the grill bars and the intervening grooves. And these are difficult to dislodge and remove. Also, attempting to clean the surfaces with conventional metal brushes lead to the charred debris dropping into the housing of the grill as well as to the floor.

The current invention is designed to overcome the above problems. The cleaner according to this invention is operated only in one direction; thus the debris is likely to fly in only one direction (backwards). Further, the provision of the bristles on a wheel assures that the direction of flight of the debris will be upward, as well as backward. The prong that engages the grill bar at the front end of the cleaner is for efficiently scraping the grill bar surfaces. A further refinement in the invention is the provision of a bag at the top to capture the debris.

The combination of the above components assures efficient cleaning as well as removal of the debris without littering around the grill.

SUMMARY OF THE INVENTION

A grill cleaning device has a handle, a scraper and a rotatable bristled cleaning wheel assembly. The handle has a handle end portion and a cleaning end portion. The scraper projects from the cleaning end portion. The rotatable bristled cleaning wheel assembly has a rotatable axle held in the cleaning end portion. The bristled cleaning wheel is affixed to the axle. The bristled wheel has substantially radially extending cleaning bristles on each of the lateral ends of the cleaning wheel and two sets of opposing laterally extending bristles. Each set of lateral bristles projects inwardly from a wheel rim toward a lateral center of the wheel assembly. The bristles are wire preferably made from stainless steel or another non-corrosive metal. The ends of the laterally extending bristles are spaced from the center of the wheel a distance equal to or slightly less than a grill rod. The radially extending bristles extend from a hub end on each side of the wheel to a distance to contact either support rods of a grill underlying the grill rods or at least below the grill rods.

The grill cleaning device further has a cavity adjacent and behind the cleaning wheel in the cleaning end portion. The cavity holds a debris-holding container. The debris-holding container has an open intake for catching dislodged debris. The debris-holding container can be a folded bag assembly adapted to be stowed inside the cavity and upon unfolding becomes the debris-holding container. The folded bag includes an upper forward pull tab to raise or unfold the bag. The folded bag has a rotatable rear mounted support to hold the bag fixed open during use. The structure further has an external wheel affixed to the rear bag support, the wheel rotatable and pivots the support to move the bag into or out of a folded condition. The bag is fixed to the scraper at a lower forward tab. The upper pull tab has a snap to fit onto a projecting pin on the scraper which also holds the lower tab. The bag can be made of a woven fabric or can be made of a thermoplastic. The bag is preferably detachable for cleaning and can be disposable.

The cleaning wheel assembly rotates counterclockwise upon a rearward pull of the handle. The counterclockwise rotation of the cleaning wheel causes dislodged debris to be directed on either lateral side of the scraper rearwardly and upwardly into the debris-holding container, some portion of the loose debris may fall into the bottom of the grill, most however is captured in the debris-holding container.

The handle portion has a threaded hole and the cleaning end portion has a threaded shaft for securing the two portions. The handle portion further comprises an outer grip sleeve, the grip sleeve fits over the handle.

The grill cleaning device can be manufactured with the debris cleaning end portion being a molded plastic structure, more preferably, a metal structure of aluminum or stainless steel. The scraper is made of steel or another metal. The handle end portion can be wood, plastic or more preferably, a metal structure of aluminum or stainless steel. The handle grip sleeve can be a thin membrane of plastic or elastomeric material.

BRIEF DESCRIPTION OF THE DRAWINGS

The invention will be described by way of example and with reference to the accompanying drawings in which.

DETAILED DESCRIPTION OF THE INVENTION

Figure 1:
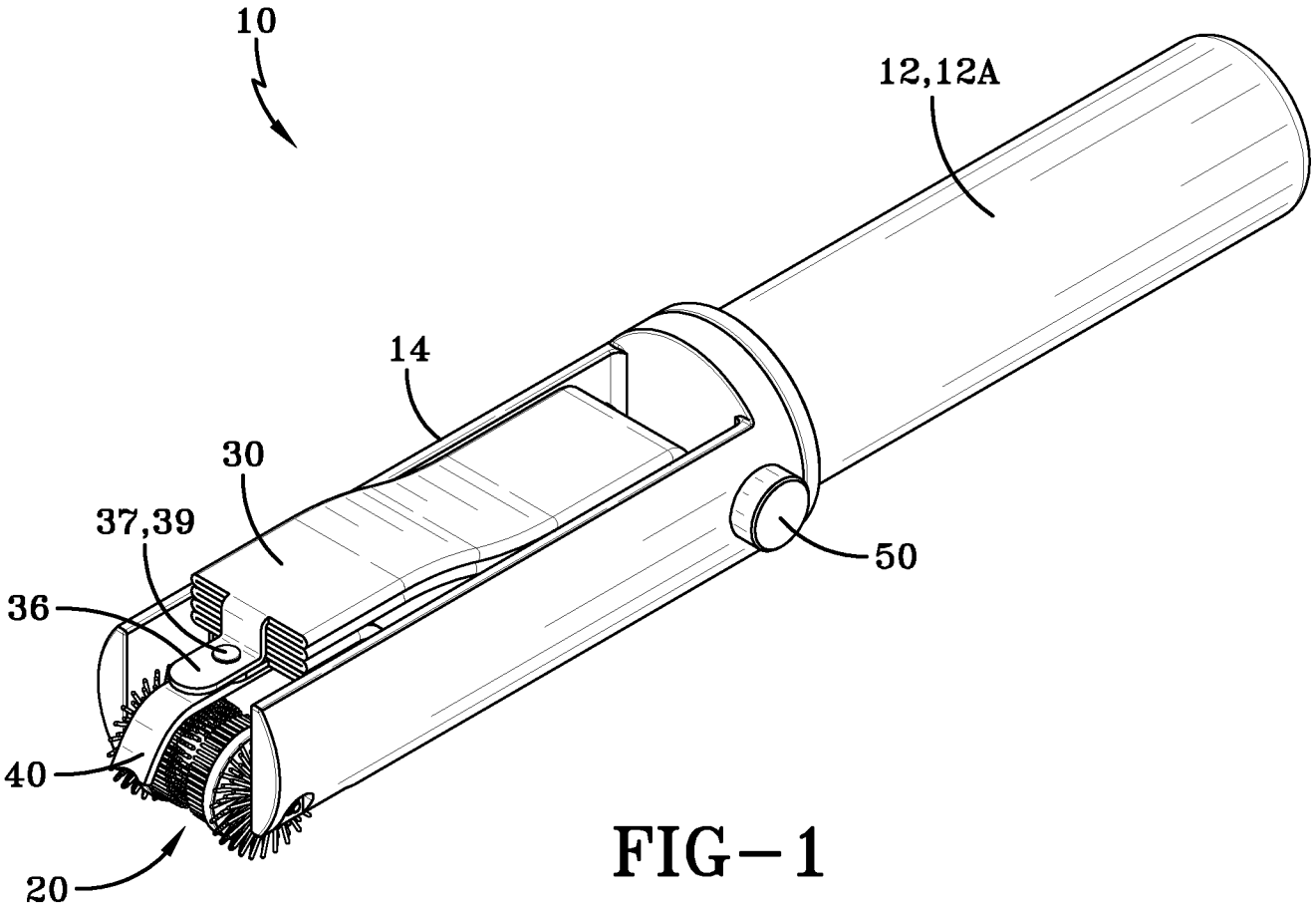
FIG. 1 is a perspective view of the grill cleaning device made according to the present invention.

With reference to FIG. 1, a grill cleaning device 10 is shown. The device 10 has a handle 12, a scraper 40 and a rotatable bristled cleaning wheel assembly 20. The device 10 has a handle end portion 12 and a cleaning end portion 14. The scraper 40 projects from the end of the cleaning end portion 14. The rotatable cleaning wheel assembly 20 has a rotatable axle held in the cleaning end portion 14. As illustrated, the device 10 further has a folded debris container 30. The folded container 30 as illustrated can be a fabric or plastic member that is shown in a collapsed and folded state. An upper forward end tab 36 is shown that is snapped to the scraper assembly 40 using a snap-in fastener 37.

Figure 2:
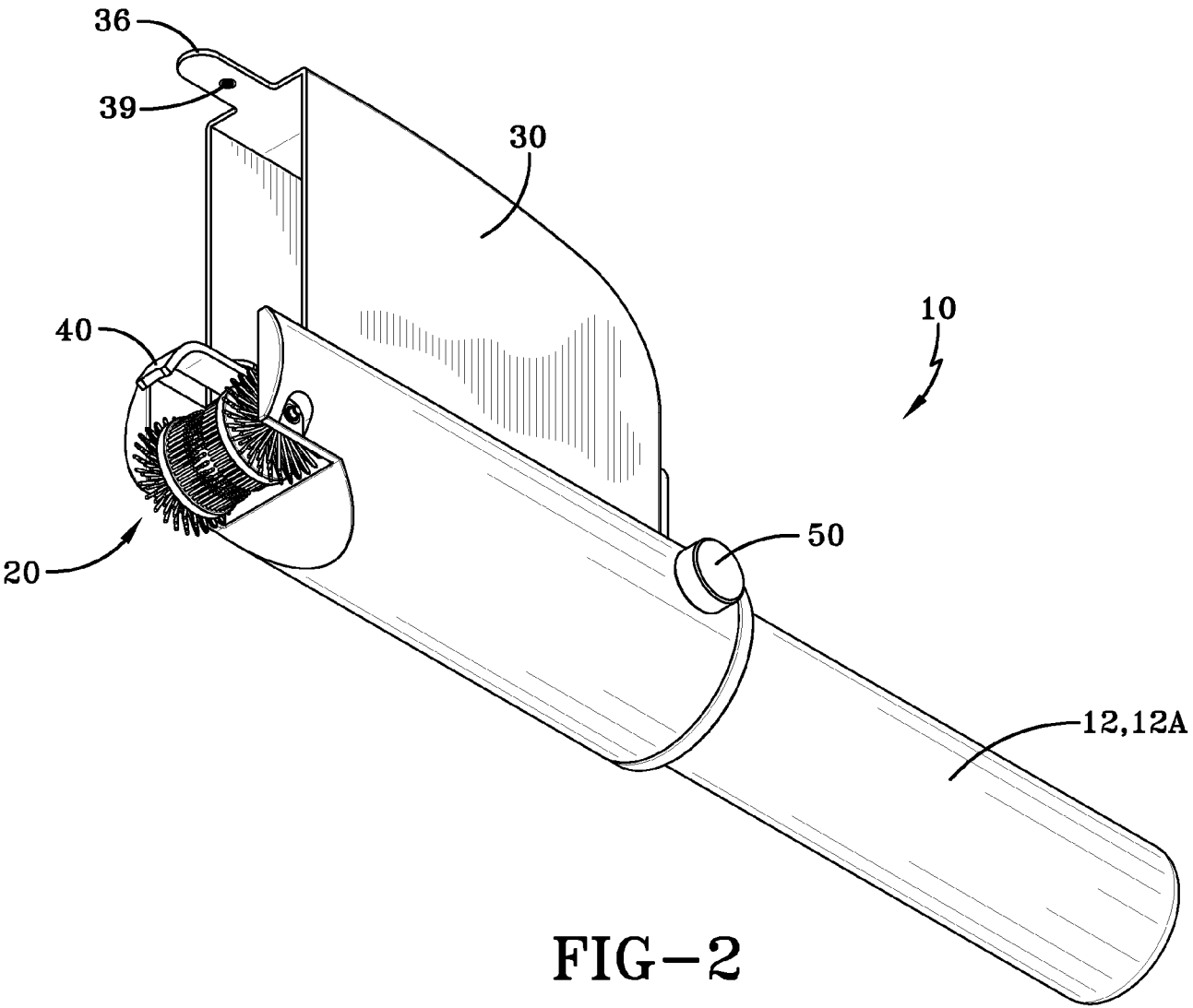
FIG. 2 is a second perspective view looking upwardly at the grill cleaning device from FIG. 1 showing the folded debris-collecting container fully extended and the cleaning wheel assembly and scraper at the cleaning end portion.
Figure 3:
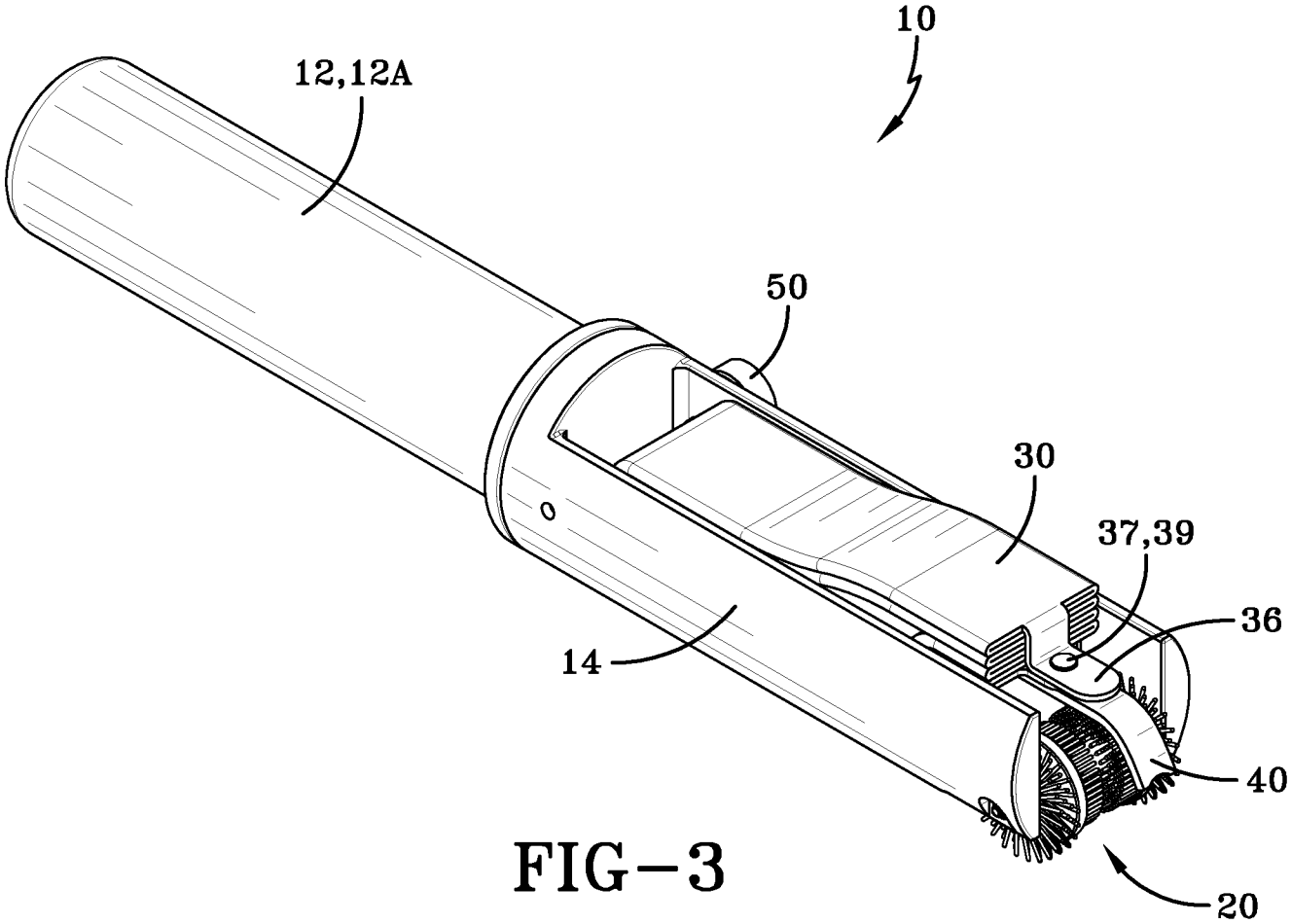
FIG. 3 is a third perspective view of the grill cleaning device with the debris-collecting container shown folded in a retracted position.
Figure 4:
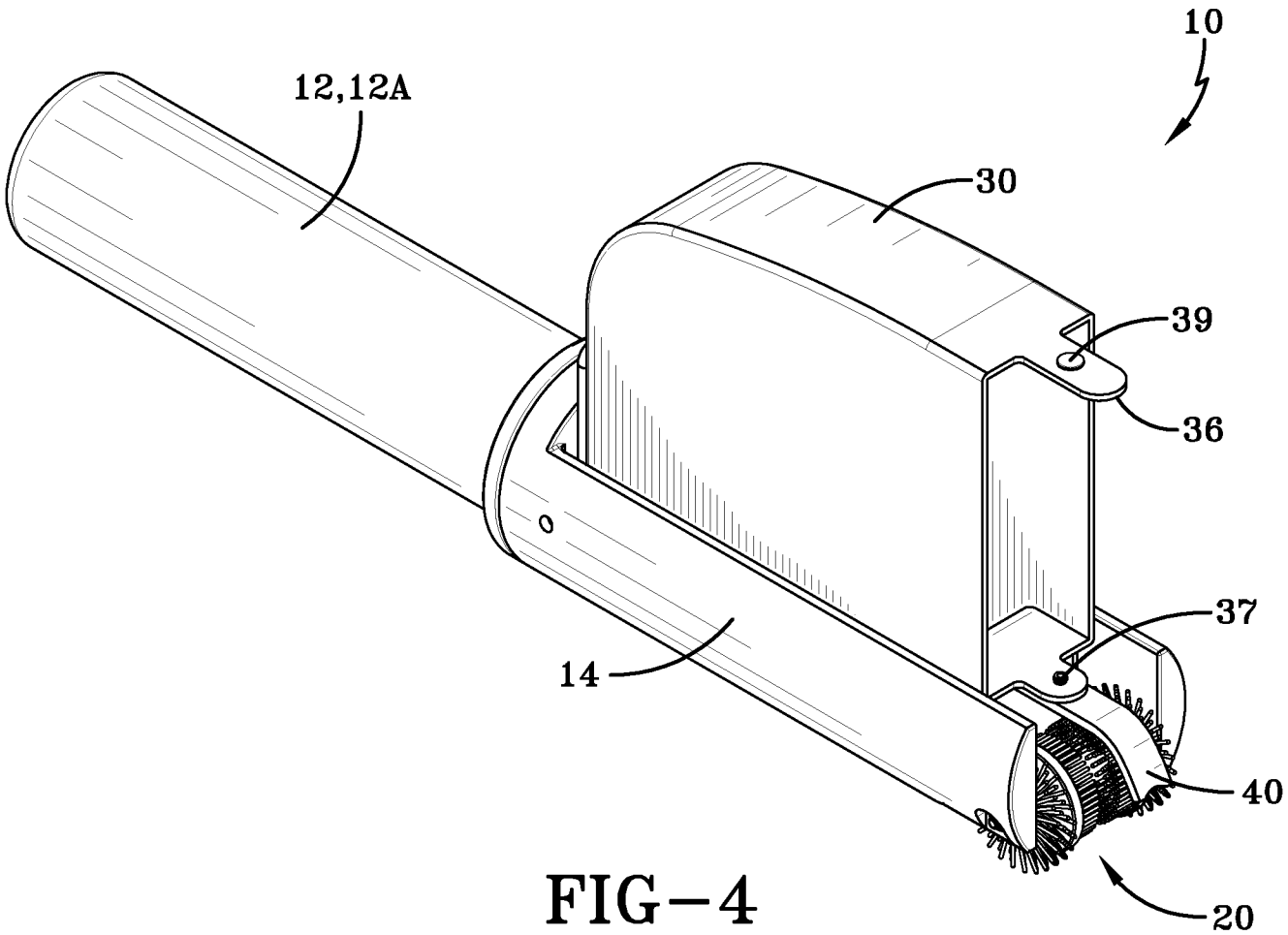
FIG. 4 is a fourth perspective view similar to FIG. 3, but with the debris-collecting device fully extended and open.

With reference to FIGS. 2, 3 and 4, various perspective views of the assembly are shown. In FIG. 2, the device 10 is shown with the debris-holding container 30 in a released, fully extended position such that the debris container 30 can receive debris from the wire wheel assembly 20 during the cleaning procedure. With reference to FIG. 3, another perspective view is shown of the device 10. In this view the folded debris container 30 is shown secured at the fastener 37 in its folded and retracted condition. In FIG. 4, the debris container 30 is shown in the same view as FIG. 3 only with the container 30 being in the fully extended and upward position. In this position, the support 32 helps maintain the folded bag in this upright and fully opened position.

Figure 5:
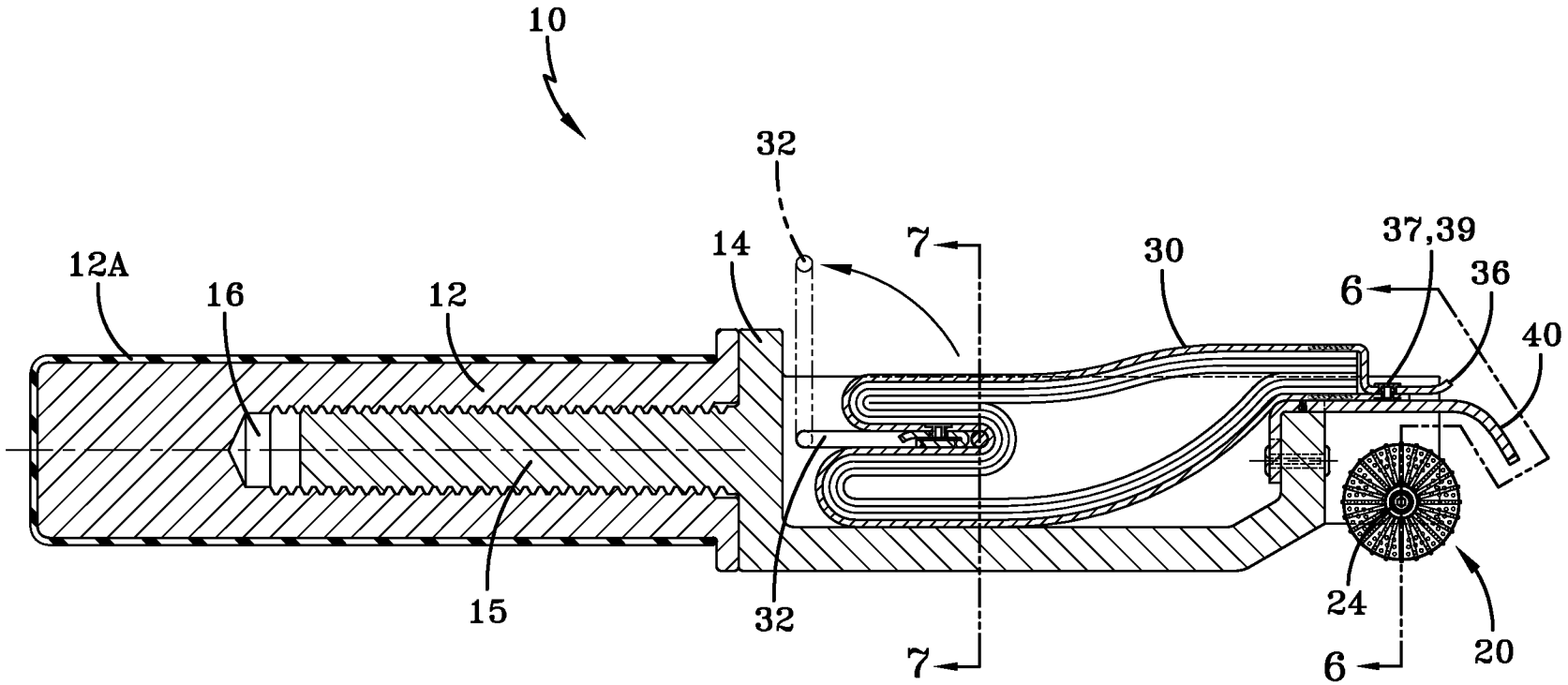
FIG. 5 is a cross sectional view of the grill cleaning device taken along the longitudinal length of the device.

With reference to FIG. 5, a cross sectional view of the device 10 is shown. The handle end portion 12 is shown threadingly engaged onto a shaft 15 of the end cleaning portion 14. To accomplish this fastening of the two portions, a threaded opening 16 is provided in the handle portion 12. The handle portion 12 is further shown with an elastomeric sleeve or covering 12A that surrounds the handle 12. This elastomeric or plastic sleeve 12A is provided to give the user a gripping surface upon which to hold the device 10. As further illustrated, in the cleaning end portion 14 the support 32 is shown horizontal in the stowed position. In dashed lines, this support 32 is rotated vertically in a vertical position when the container 30 is moved to the fully upright and open extended position. The wheel assembly 20 underlies the scraper 40 as illustrated and is held to the end portion 14 via an axle 24.

Figure 6:
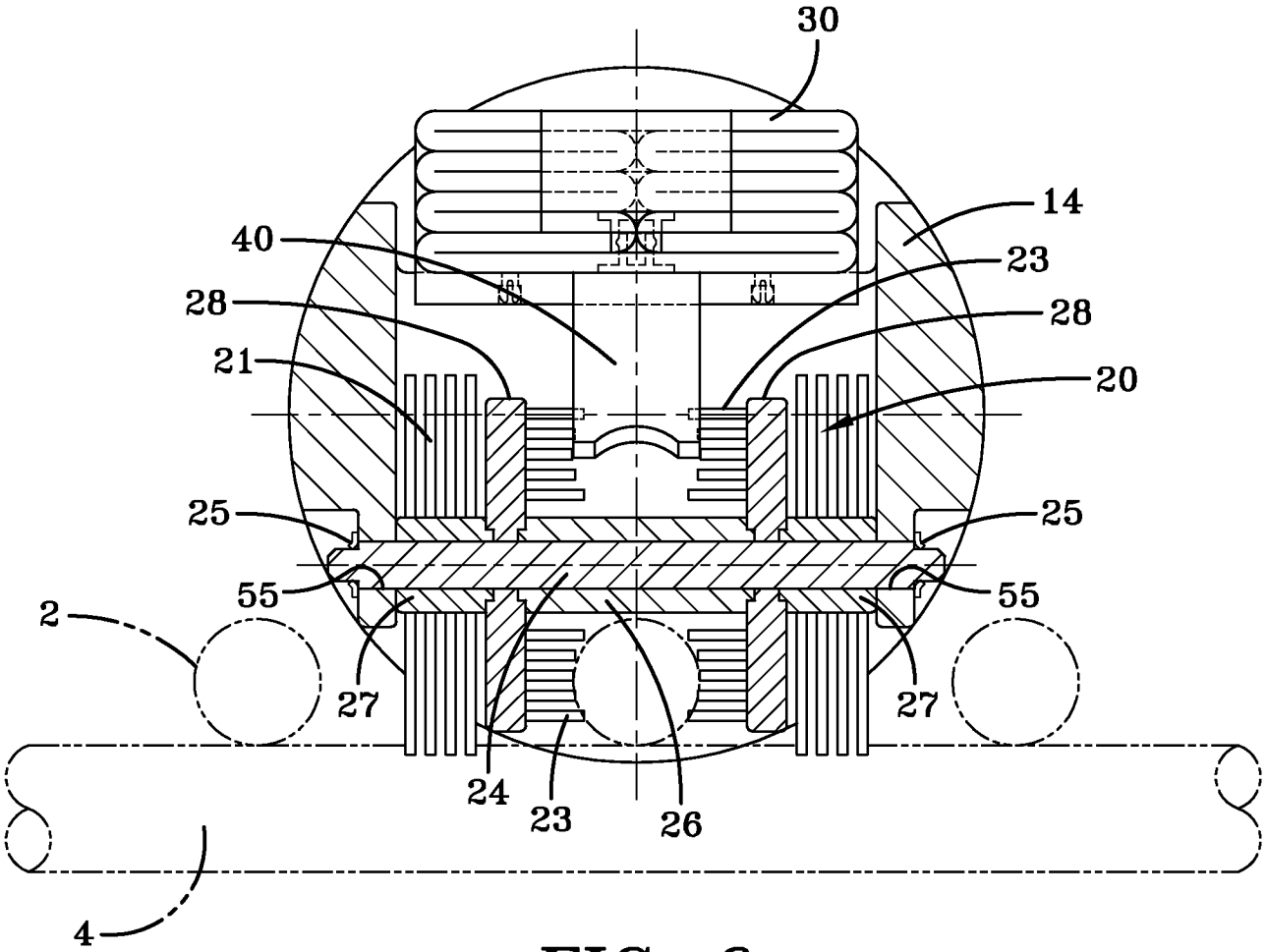
FIG. 6 is an end cross sectional view taken along the dashed or broken line 6-6 from FIG. 5, the dashed lines of FIG. 6 show an exemplary grill.
Figure 9:
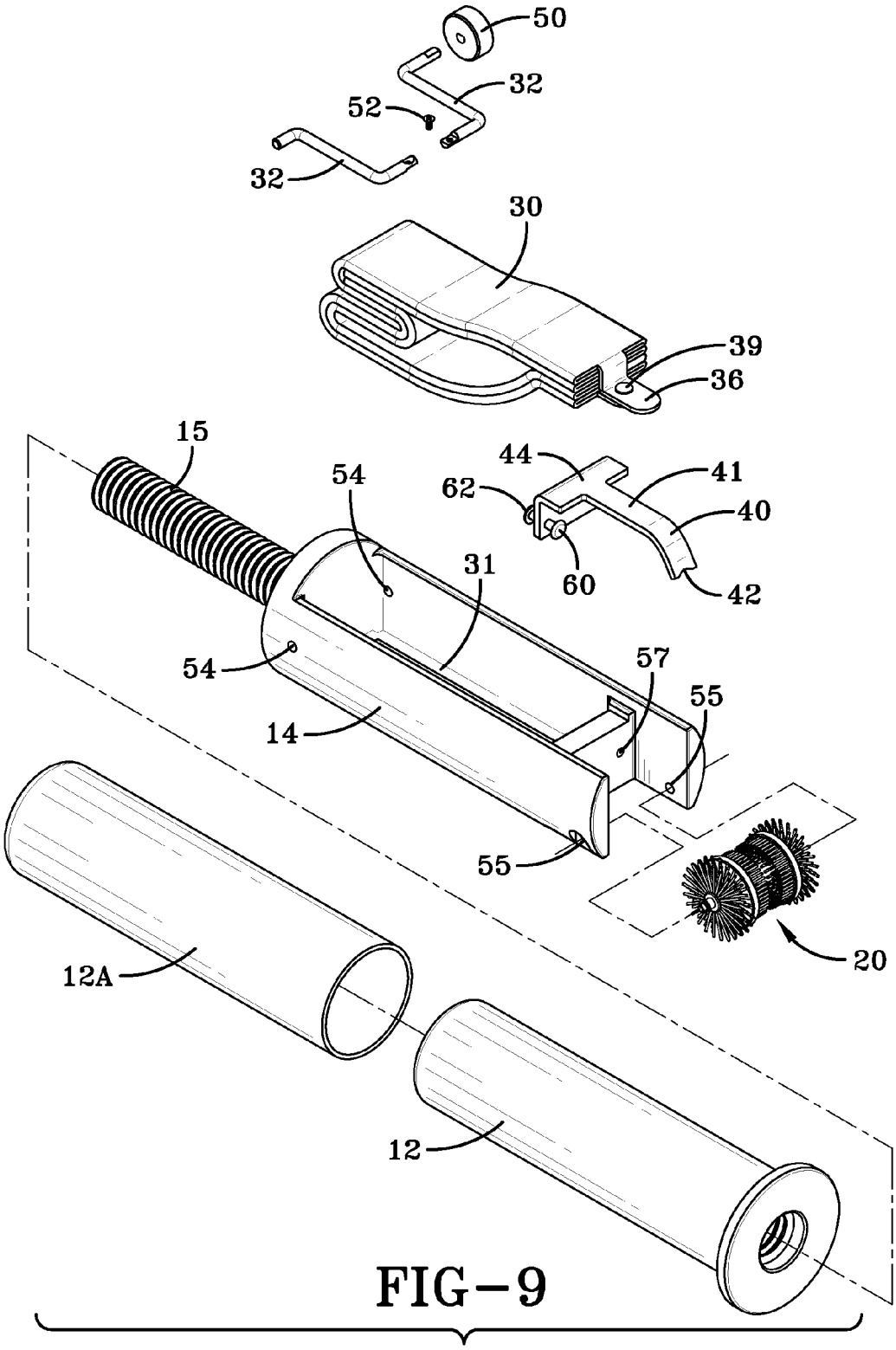
FIG. 9 is an exploded view of the grill cleaning device made according to the present invention.
Figure 10:
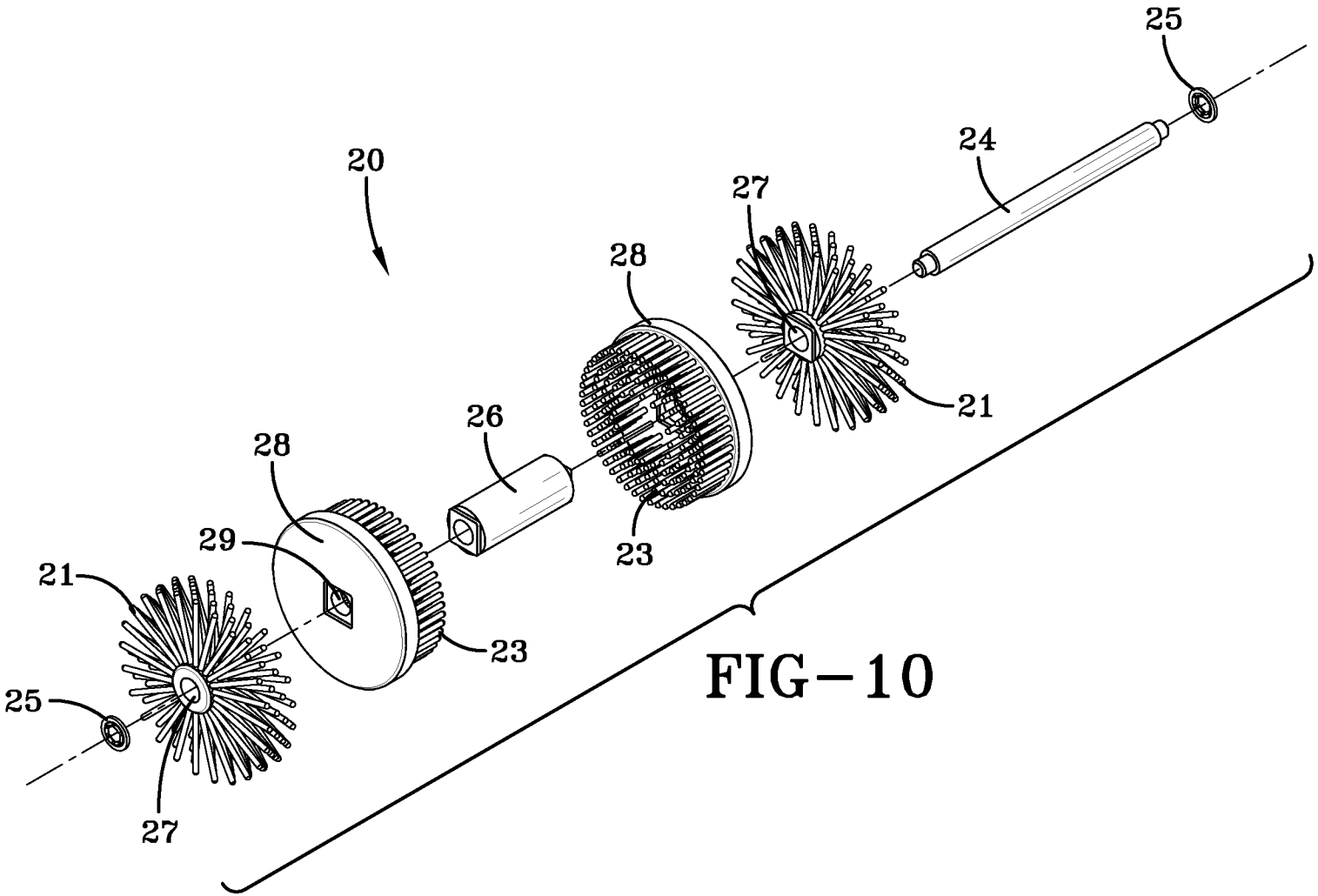
FIG. 10 is an exploded view of the bristled cleaning wheel assembly.
Figure 11:
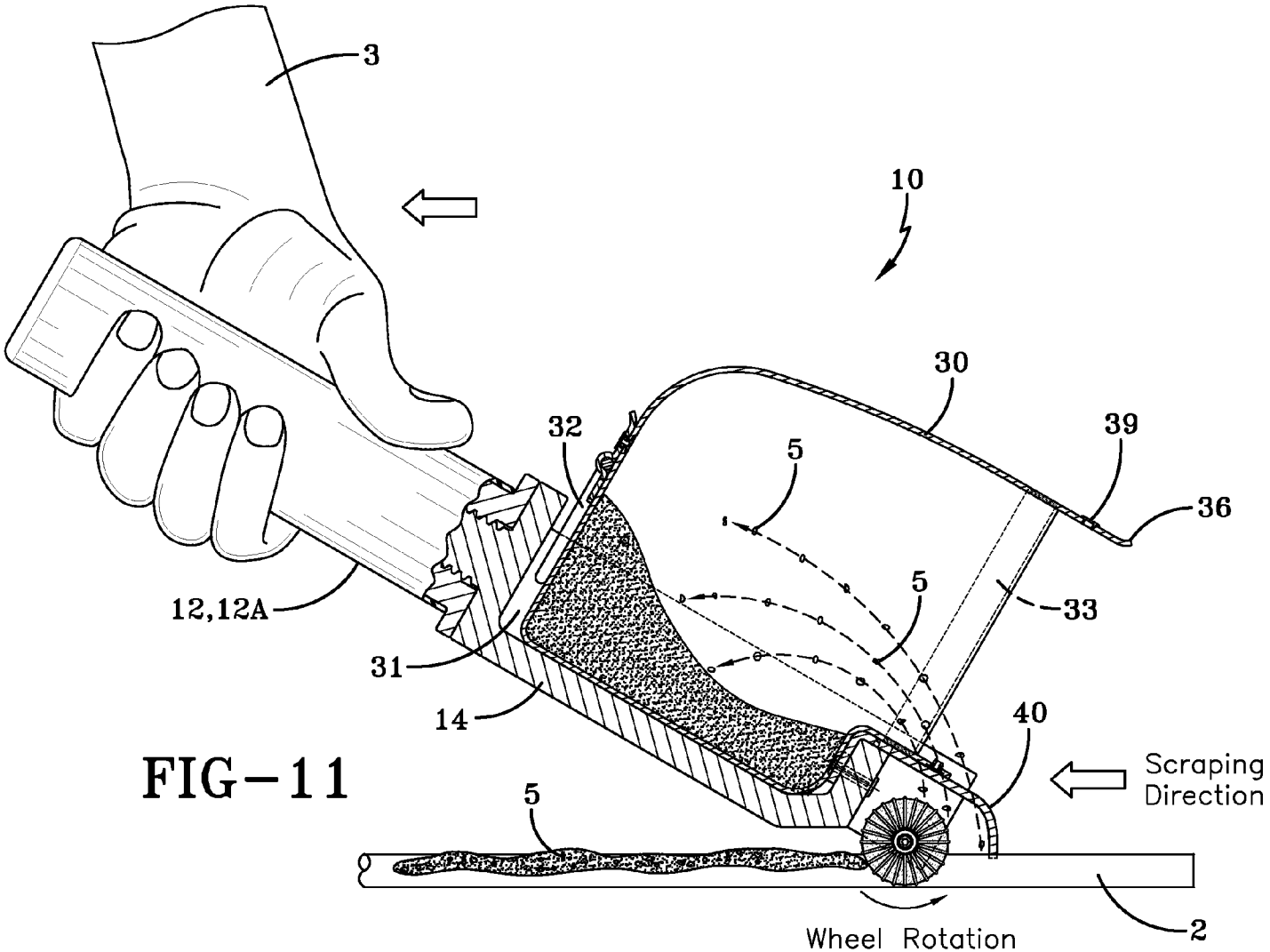
FIG. 11 is a view of the grill cleaning device in use.

With further reference to FIGS. 6 and 10, the rotatable bristled wheel assembly 20 is illustrated. In FIG. 6, a cross sectional view of the device 10 cut along line 6-6 from FIG. 5 shows the wheel assembly 20 in its mounted condition held securely in the end portion 14. As shown, with reference to FIGS. 5 and 9, the axle 24 extends across the wheel assembly 20 into openings 55 on each side of the end portion 14. This axle 24 is retained by retaining washers 25 that are snapped over the ends of the axle 24 pinning the axle in the end portion 14 as illustrated in FIG. 6. Inward of the retaining washers 25 and the sides of the end portion 14 are shown radially extending wire wheels 21. These wire wheels 21 are formed from wire bristles extending radially outwardly. These wire wheels 21 have a center hub 27. The center hub 27 has a square or rectangular end on each laterally inward side of the wheel 21. The square hub 27 is adapted to fit into the rims 28 and lock into a square opening 29 on the rim 28 itself, as shown in FIG. 10. Projecting from the rim 28 are laterally extending wire bristles 23. These laterally extending wire bristles 23 are directed facing the opposite laterally extending wire bristles 23 on the opposite rim 28. These rims 28 are fitted into a center hub 26 and are rotatably fixed to the hub 26 in such a fashion that as the wheel assembly 20 rotates, the center hub 26 and both of these rims 28 with laterally extending wire bristles 23 will rotate in a counterclockwise direction as the handle assembly 12 is pulled toward the user. This is best illustrated in FIG. 11 showing the hand 3 of an operator pulling the device 10 backwards along the rods 2 wherein the debris 5 on the rod 2 is then flipped off the rod 2 with the lateral extending wire bristles 23 rotating in such a fashion that the debris 5 is either thrown generally rearwardly and upwardly into the debris-holding container 30 as illustrated through the opening 33. This debris 5 projects on each side of the scraper 40. The scraper 40 provides a means to pull any remaining surface debris 5 along the top surface of the rod 2. The lateral bristles 23 loosen and deflect a large portion of the debris 5 as the wheel assembly 20 rotates. To facilitate rotation, the center hub 26 can be pushed against the rods 2 upon which the hub 26 is riding. This provides additional rolling assistance for the wheel assembly 20 as it is being turned and pulled over the rods 2 cleaning them. The radially extending bristles 21 extend from a hub 27 end on each side of the wheel assembly 20 to a distance to contact either support rods 4 of a grill underlying the grill rods 2 or at least below the grill rods 2, as shown in FIG. 6.

Figure 7:
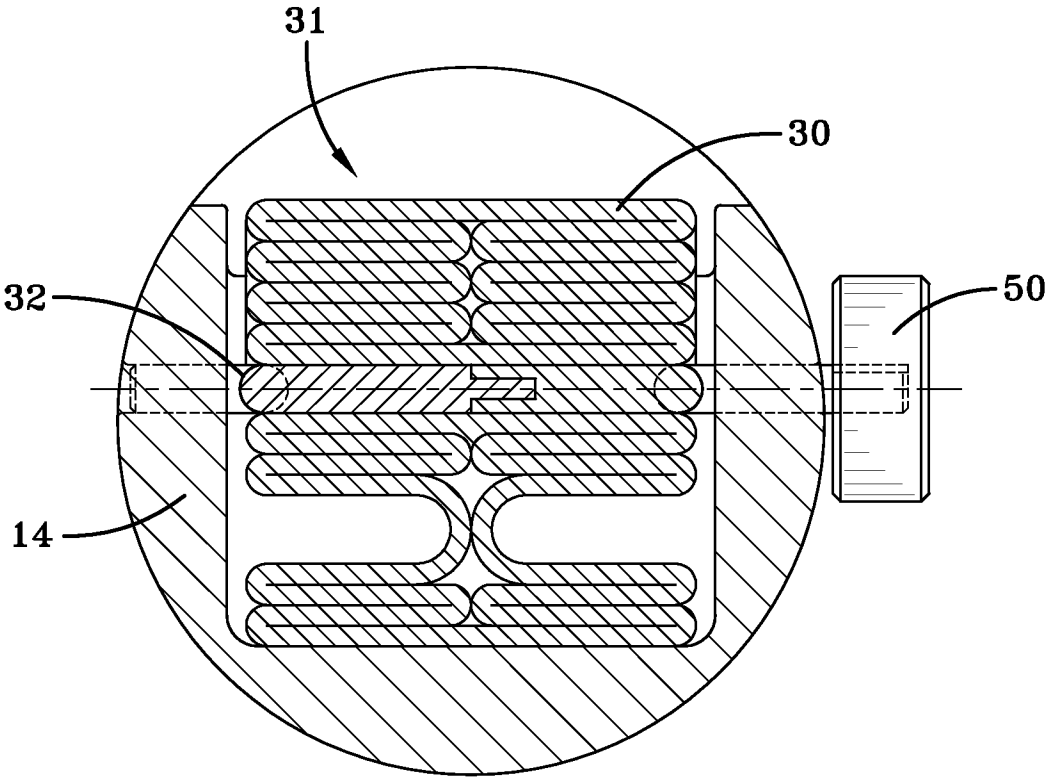
FIG. 7 is an end cross sectional view of the folded debris container taken along dashed or broken line 7-7 taken from FIG. 5.

With reference to FIG. 7, the debris container 30 is shown in a folded and retracted position inside a cavity 31 in the end portion 14. A knob 50 is shown attached to the support 32 of the device 10 such that the wheel 50 can be rotated to move the support 32 from a horizontal stowed position to a vertical position as the bag 30 is being extended into its fully opened position.

Figure 8:
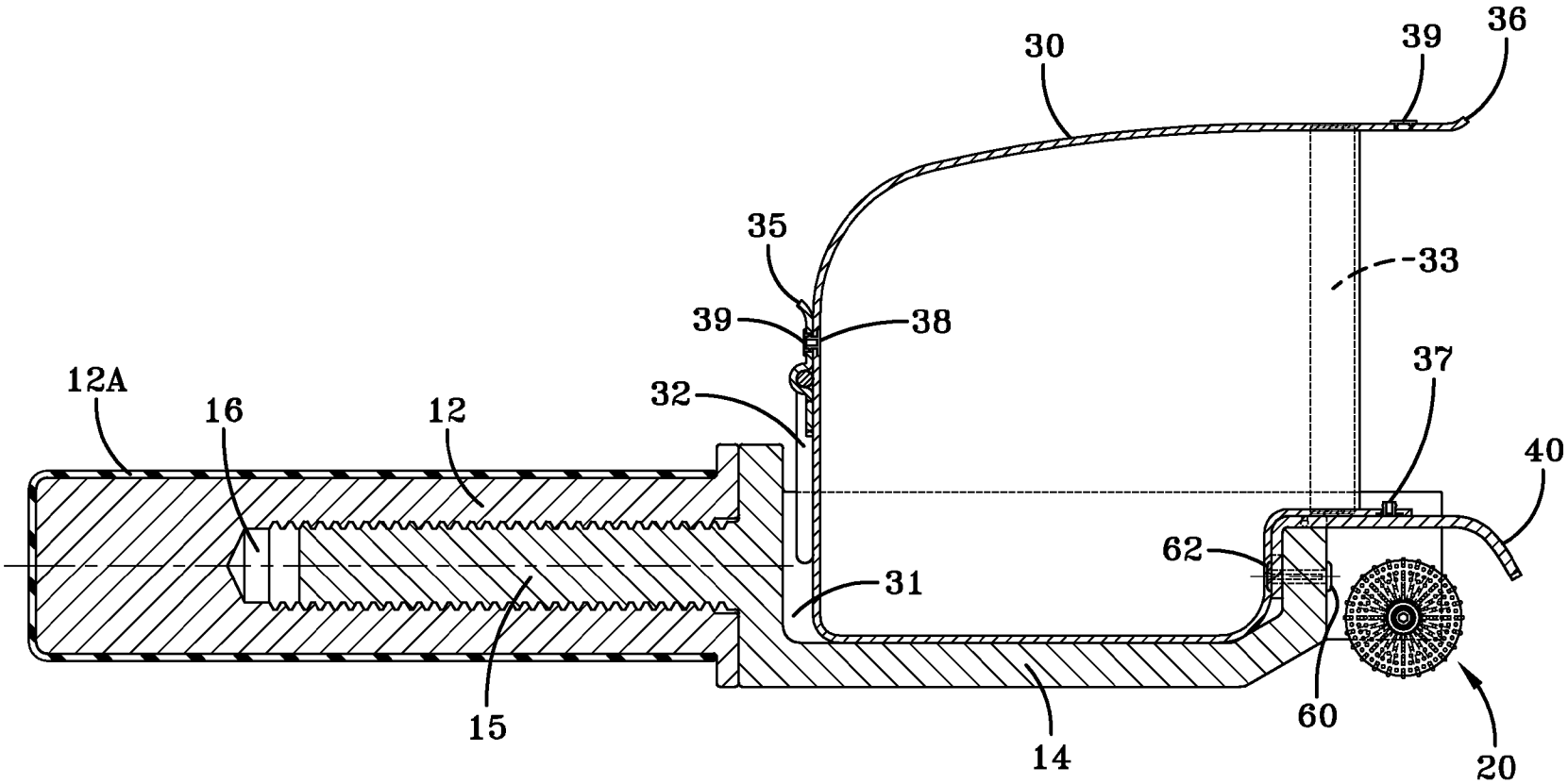
FIG. 8 is a longitudinal cross sectional view similar to FIG. 5, but with the debris-collecting container fully extended and open.

With reference to FIG. 8, this is best shown in the fully open position wherein the container 30 is extended from the cavity 31 in the end portion 14. With further reference to FIG. 8, the container 30 is held by snaps 39, 38 and 37 and snaps 60, 62. To remove the container 30, one simply pulls the snaps open releasing the container 30. The container 30 can be cleaned or washed or discarded and replaced at the user's option.

With reference to FIG. 9, an exploded view of the entire device 10 is shown. In this view, the scraper 40 is more clearly shown having a projected end 41 with a scraper surface 42 that extends back to a flanged end 44. This flanged end 44 has openings to hold snaps or rivets 60, 62 which can securely hold the scraper 40 into position. Preferably these snaps or rivets 60, 62 are solidly riveted to the end portion 14 through the openings 57 shown in FIG. 9. Additionally, the support 32, formed as two portions held together by fastener 52, extends through openings 54 on each side of the end portion 14. The axle 24 of the wheel assembly 20 extends through the openings 55 in this end portion 14 as shown in FIG. 5. As further shown, the handle 12 is shown in a preferred embodiment with the opening 16 being threaded. The handle 12 being a solid structure having a flexible sleeve 12A covering it.

It is important that the wire bristles on both the radially extending wheel 21 and laterally extending wires 23 on the rims 28 of the wire wheel assembly 20 be made of a tough durable material, preferably a stainless steel or aluminum material of high stiffness. This will ensure that the wheels 20 when rotating about the rods 2 of the grill cleaning it can provide enough rigidity to break free the debris 5 from the rods 2 of the grill allowing the debris 5 to be removed easily. The cleaning end portion 14 and the handle portion 12 can be made of a lightweight aluminum or stainless steel or other metal material or alternatively can be made of heavy duty fabric material if so desired or the handle alternatively could be made of wood. It is believed that preferably lightweight aluminum assembly provides the most advantageous construction as it provides both corrosion resistance and strength.

The present invention provides a mechanical grill cleaning device 10 that requires no vacuum assist in collecting debris or battery operated rotation of the wheel assembly 20, although such additions could be used without departing from the inventive concept. It is believed preferable that the entire cleaning can be manually accomplished with the device 10. One of the main objectives is to keep the surroundings of the grill from being splattered by the charred dislodged debris 5. It is further important that the debris 5 mainly is captured in the debris container 30 with some residual debris 5 being dropped into the bottom of the grill, but otherwise not allowing the dislodged debris 5 from spraying over the patio deck as is a common problem with conventional grill cleaning.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims.

What is claimed is:

1. A grill cleaning device comprises:

a handle, having a handle end portion and a cleaning end portion;

a scraper projecting from the cleaning end portion;

a rotatable bristled cleaning wheel assembly, the wheel assembly having a rotatable axle held in the cleaning end portion and a bristled cleaning wheel affixed to the axle, the bristled wheel having substantially radially extending cleaning bristles on each of the lateral ends of the cleaning wheel and two sets of opposing laterally extending bristles, each set of lateral bristles projecting inwardly from a wheel rim toward a lateral center of the wheel.

2. The grill cleaning device of claim 1 wherein the bristles are wire.

3. The grill cleaning device of claim 1 wherein the ends of the laterally extending bristles are spaced from the center of the wheel a distance equal to or slightly less than a grill rod.

4. The grill cleaning device of claim 1 wherein the radially extending bristles extend from a hub end on each side of the wheel to a distance to contact either support rods of a grill underlying the grill rods or at least below the grill rods.

5. The grill cleaning device of claim 1 wherein the cleaning end portion further comprises a cavity adjacent and behind the cleaning wheel.

6. The grill cleaning device of claim 5 wherein the cavity holds a debris-holding container.

7. The grill cleaning device of claim 6 wherein the debris-holding container has an open intake for catching dislodged debris.

8. The grill cleaning device of claim 7 wherein the debris-holding container is a folded bag assembly adapted to be stowed inside the cavity and upon unfolding from the debris-holding container.

9. The grill cleaning device of claim 8 wherein the folded bag includes a pull tab to raise or unfold the bag.

10. The grill cleaning device of claim 9 wherein the folded bag has a rotatable rear mounted support to hold the bag fixed open during use.

11. The grill cleaning device of claim 10 wherein the cleaning end further comprises an external wheel affixed to the rear bag support, the wheel rotatable to move the bag into or out of a folded condition.

12. The grill cleaning device of claim 8 wherein the bag is made of a woven fabric.

13. The grill cleaning device of claim 8 wherein the bag is made of a durable fabric.

14. The grill cleaning device of claim 9 wherein the bag is fixed to the scraper at a lower forward tab.

15. The grill cleaning device of claim 14 wherein the bag the pull tab has a snap to fit onto a projecting pin on the scraper holding the lower tab.

16. The grill cleaning device of claim 1 wherein the cleaning wheel assembly rotates counterclockwise upon a rearward pull of the handle.

17. The grill cleaning device of claim 16 wherein the counterclockwise rotation of the cleaning wheel causes dislodged debris to be directed on either lateral side of the scraper into the bottom of the grill or into the debris-holding container.

18. The grill cleaning device of claim 1 wherein the handle end portion has a threaded hole and the cleaning end portion has a threaded shaft for securing the two portions.

19. The grill cleaning device of claim 18 wherein the handle end portion further comprises an outer grip sleeve, the grip sleeve fits over the handle end portion.

20. The grill cleaning device of claim 19 wherein the cleaning end portion is a molded plastic structure and the scraper is steel or metal and the handle end portion is wood or plastic and the handle grip sleeve is a thin membrane of plastic or elastomeric material.

* * * * *